US005228771A

United States Patent [19]

Zimmerman

[11] Patent Number: 5,228,771

[45] Date of Patent: Jul. 20, 1993

[54] TRANSPARENT TABLE LAMP

[75] Inventor: Robert C. Zimmerman, Manlius, N.Y.

[73] Assignee: Hollowick, Inc., Manlius, N.Y.

[21] Appl. No.: 856,297

[22] Filed: Mar. 23, 1992

[51] Int. Cl.[5] ..... F21L 19/00

[52] U.S. Cl. ..... 362/171; 362/163; 362/182; 362/315; 362/447; 431/291

[58] Field of Search ..... 362/171, 173, 182, 315, 362/415, 447, 161, 163, 172; 431/344, 291, 289, 151

[56] References Cited

U.S. PATENT DOCUMENTS

| | | | |
|---|---|---|---|
| 25,406 | 9/1859 | Hale | 362/315 |
| 56,999 | 8/1866 | Schartan | 362/315 |
| 193,013 | 7/1877 | Martin | 362/315 |
| 241,730 | 5/1881 | Schneider | 362/315 |
| 247,822 | 10/1881 | Hastings | 362/315 |
| 272,567 | 2/1883 | Marsh | 362/415 |
| 272,946 | 2/1883 | Chinnock | 362/415 |
| 589,416 | 9/1897 | Collinge | 362/315 |
| 1,138,240 | 5/1915 | Nash | 362/447 |
| 1,867,420 | 7/1932 | Root | 431/291 |
| 4,017,729 | 4/1977 | Frazier, Jr. | 362/161 |
| 4,524,408 | 6/1985 | Minera | 431/291 |
| 4,526,530 | 7/1985 | Menter et al. | 431/34 |
| 4,894,008 | 1/1990 | Lee | 431/291 |
| 5,055,035 | 10/1991 | Hancovsky | 362/315 |

FOREIGN PATENT DOCUMENTS

| | | | |
|---|---|---|---|
| 0020859 | of 1894 | United Kingdom | 431/289 |
| 0009912 | 4/1898 | United Kingdom | 362/315 |
| 0176289 | 3/1922 | United Kingdom | 362/415 |

*Primary Examiner*—Ira S. Lazarus
*Assistant Examiner*—Alan B. Cariaso
*Attorney, Agent, or Firm*—Wall and Roehrig

[57] ABSTRACT

A table lamp that utilizes a fuel cell having a hollow glass or plastic envelope that includes an elongated body section joined to an expanded base by a pinched neck, and a flame shield mounted upon the top of the body section. The fuel cell has an elongated fuel container that rests upon the pinched neck of the envelope and a burner that is positioned within the flame shield. The flame shield has a top opening that permits the fuel cell to be inserted or removed from the envelope therethrough. A shade may be removably mounted upon the flame shield and a decorative insert slidably positioned between the fuel cell and the body of the envelope.

13 Claims, 3 Drawing Sheets

TRANSPARENT TABLE LAMP

BACKGROUND OF THE INVENTION

This invention relates to a transparent table lamp, and more particularly, to a glass or plastic table lamp that utilizes a liquid fuel cell as a source of energy.

Lamps for providing intimate table lighting are becoming more and more popular in public gathering places, restaurants and in the home. Many of these lamps employ liquid fuel cells which provide a soft intimate lighting. These cells are typically clean burning and have a relatively long burning time. As described in U.S. Pat. No. 4,526,530, an inexpensive, disposable-type cell has been devised which eliminates the need of having to replenish the fuel in the cell, thus avoiding problems of fuel spillage. In addition, these disposable cells are equipped with burners that will return any excess fuel delivered to the wick back to the fuel reservoir.

Lamp structures for accommodating liquid fuel cells usually include a number of parts that can be easily disassembled to permit the cell to be inserted or removed therefrom. The lamp typically consists of a metal base that encircles the body of the cell and a removable glass globe seated upon the base ,or the cell itself. The globe surrounds the burner of the cell and provides a shield for protecting the flame. Most manufacturers preset the height of the burner wick in the factory to provide for the most efficient burning and then will lock the wick in place. When used in restaurants, patrons, on occasion, will disassemble the lamp and attempt to adjust the burner wick, thus damaging the cell.

SUMMARY OF THE INVENTION

It is therefore a primary object of the present invention to improve decorative table lamps utilizing independent fuel cells.

Another object of the present invention is to provide a decorative table lamp suitable for use in restaurants, and the like, which discourages tampering with the fuel cell.

A further object of the present invention is to provide a table lamp utilizing a replaceable fuel cell having a decorative decor that can be selectively changed.

A still further object of the present invention is to provide a decorative table lamp that utilizes a liquid fuel cell wherein a single-piece glass envelope houses the fuel cell.

These and other objects of the present invention are attained by a table lamp that includes a single-piece, hollow envelope, preferably formed of glass or plastic, having a central passage passing axially therethrough. The envelope contains an elongated housing, an expanded base, a pinched neck separating the body and the base, and a flame shield positioned on top of the body. A fuel cell is slidably insertable through the top opening in the flame shield into the body section where it is seated upon the pinched neck. When seated upon the neck, the burner of the fuel cell is situated within the flame shield. An insert having a decorative design may be slidably received between the fuel cell and the body of the envelope and a glass shade may also be removably mounted upon the flame shield.

BRIEF DESCRIPTION OF THE DRAWINGS

For a better understanding of these and other objects of the present invention, reference will be made to the following detailed description of the invention which is to be read in conjunction with the accompanying drawings, wherein.

DESCRIPTION OF THE INVENTION

Figure 1:
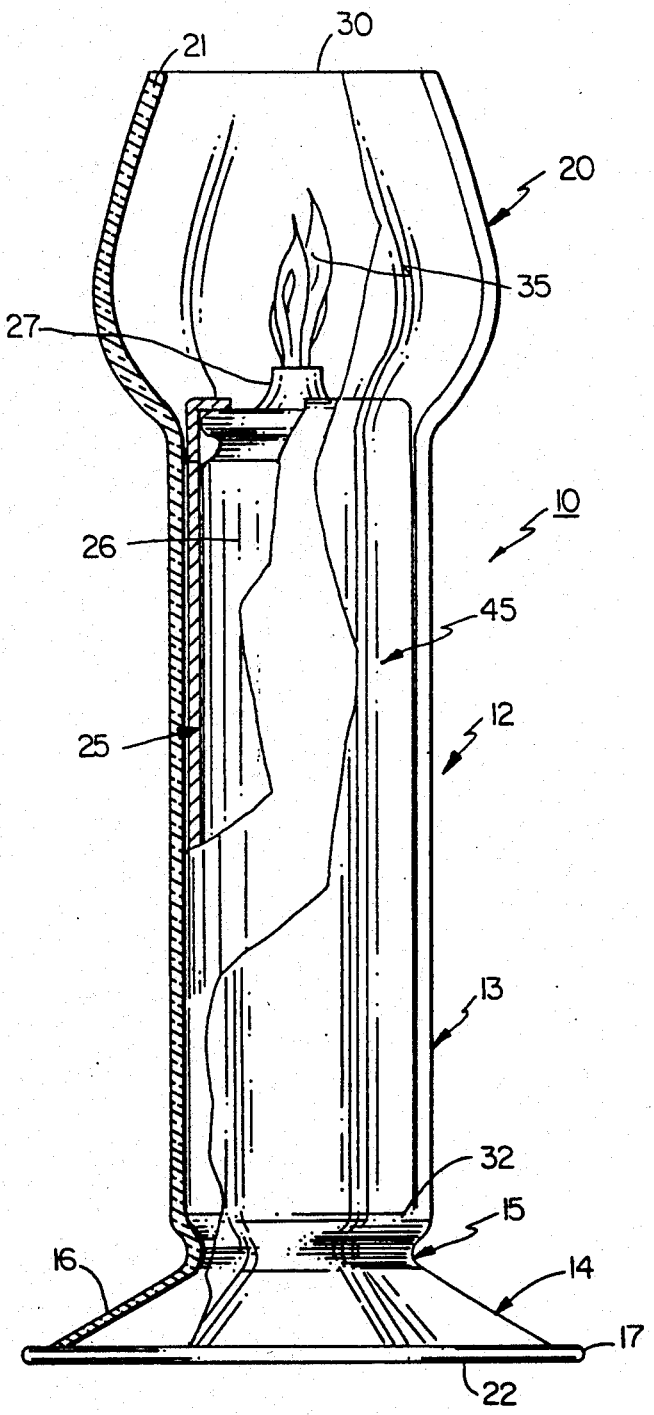
FIG. 1 is a side elevation, in partial section, showing a first embodiment of the present invention.

Turning initially to FIG. 1, there is shown a table lamp, generally reference 10, that embodies the teachings of the present invention. The lamp includes a single-piece envelope 12 that is preferably formed of a transparent material such as glass or plastic in four individual sections. The envelope is a hollow structure having a central opening passing axially therethrough. The first of these sections is a cylindrical-shaped, elongated body section 13 that is joined to a radially-expanded, circular base section 14 by a pinched neck 15. The base has an inclined side wall 16 that terminates in a wide circular, horizontal ring 17 that provides a stable platform for the glass envelope which makes it extremely difficult to tip the envelope when it is standing vertically, as shown, on a flat, horizontal surface. A flame shield 20 is situated on top of the body section of the envelope. In this embodiment of the invention, the flame shield is in the shape of an expanded globe that terminates in a flat, top edge 21.

The envelope 12 houses a disposable fuel cell 25. A reusable fuel cell of similar construction may also be utilized in the lamp without departing from the teachings of the present invention. The fuel cell includes an elongated container 26 in which is stored a quantity of liquid fuel and a burner unit 27 centrally located in the top wall of the fuel container. The outside diameter of the container is smaller in size than the inside diameter of the envelope body section, and the size of the top opening formed in the flame shield. The inside diameter of the pinched neck 15, however, is considerably smaller than the outside diameter of the container and thus provides a secure shelf upon which the bottom wall 32 of the container is securely seated in assembly.

The height of the fuel cell container is about equal to the axial length of the envelope body section. When the container is seated upon the pinched neck of the envelope, the burner unit of the cell projects upwardly into the flame shield region. The vertical height of the flame shield is sufficient to surround, and thus protect, the burner flame 35.

Typically, the flame height of the fuel cell is preset by the manufacturer in the factory to provide for the proper amount of illumination and/or for optimum fuel burning efficiency. Tampering with the exposed burner wick, of course, defeats the manufacturer's setting and thus the lamp's efficiency. Heretofore, table lamps employing such fuel cells were typically equipped with removable globes for providing easy access to the fuel cell. As a consequence, particularly in restaurant settings, tampering with the cell and the wick setting has been a problem. Because easy access is afforded to the cell, cells on occasion are taken by restaurant patrons.

The fuel cell of the present invention can be inserted or removed from the lamp envelope only through the top opening of the flame shield. To do this safely, the flame must be extinguished and the envelope tipped at a relatively steep angle. As can be seen, this task can be easily performed by a maintenance worker, yet this construction makes it extremely difficult for any unauthorized person to tamper with the fuel cell or to attempt to adjust the wick setting.

A hollow cylindrical insert 45 may be positioned between the fuel cell container and the wall of the envelope body section. The axial length of the insert is substantially equal to that of the container so that it substantially covers the container when both the sleeve and the container are seated upon the pinched neck of the envelope. The insert is a seamless tube formed of a rigid material so that the insert is self-standing. The top section of the tube contains a collar 46 that closes over the top of the fuel cell container. The collar serves a twofold function. First it shields the top part of the fuel cell, and secondly it holds the insert in contact with the fuel cell when cell is being removed from the lamp through top opening 30. The outer surface of the insert may contain decorative features such as color, texture or a scene that will add to the table decor. As should now be evident, the appearance of the lamp can insert. Although some fuel cells have an expensive metallic appearance and are thus suitable for use in the present lamp without need of an insert, other cells are rather unsightly, cheap plastic containers. As can be seen, the use of the decorative insert with these plastic devices greatly enhances the appearance of the lamp without greatly increasing the lamp cost.

Figure 2:
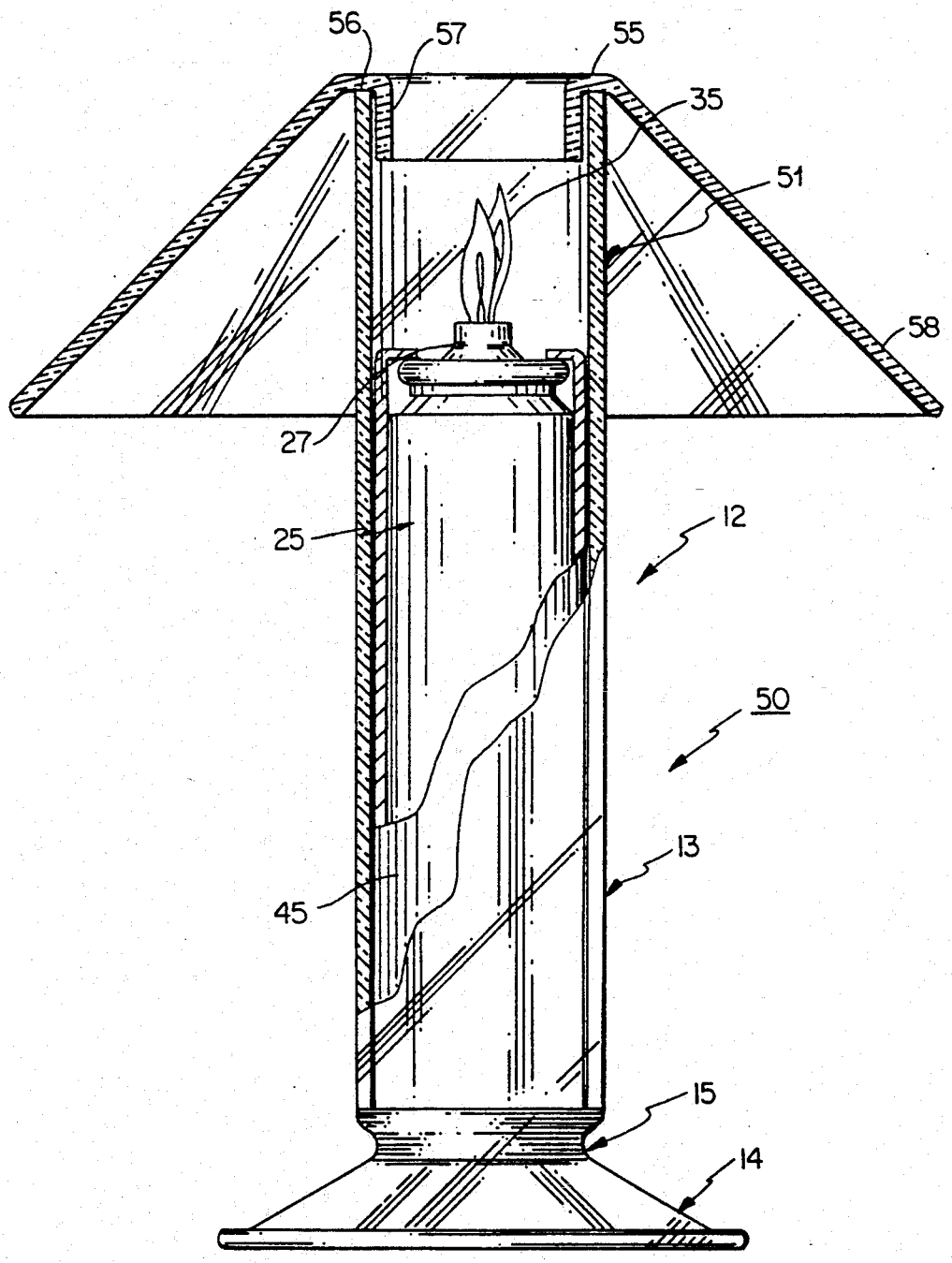
FIG. 2 is a side elevation, in partial section, of a lamp incorporating the teachings of the present invention showing a second embodiment thereof which is equipped with a removable shade.

A second embodiment of the invention is shown in FIG. 2 wherein like numbers are used to depict like parts previously includes envelope 12, and expanded circular base 14 connected to an elongated cylindrical body 13 by a pinched neck section 15. A fuel cell 25 is seated inside the envelope upon the pinched neck and a decorative insert 45 is passed between the cell and the envelope body section. In this embodiment, the flame shield 51 of the lamp is a continuation of the body section so that the two sections combine to form a tubular element having a uniform inside and outside diameter. The upper section of the tube surrounds the burner 27 and the burner flame 35, while the bottom part surrounds the fuel cell container and the decorative shield.

The lamp 50 shown in FIG. 2 further includes a lamp shade 58 which, like the envelope, is formed of a single piece of glass or plastic. The shade includes a horizontal, annular-shaped support ring 55 that is arranged to rest upon the top edge 56 of the flame shield. The inside edge of the ring is turned arranged to pass downwardly through the top opening in the flame shield. A close sliding fit is provided between the sleeve and the inner wall of the flame shield which prevents the shade from being displaced laterally in assembly. The outside edge of the ring is turned downwardly at an angle to form a skirt 57 that encircles the flame shield section of the envelope.

Figure 3:
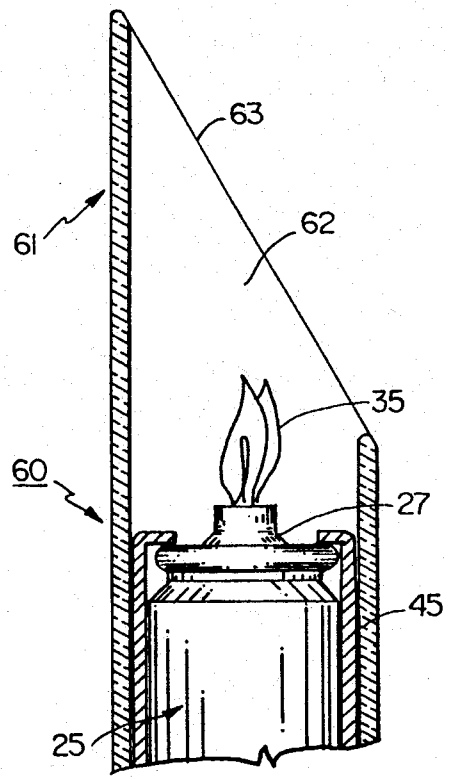
FIG. 3 is a side elevation, in section, showing a still further embodiment of the invention.

FIG. 3 is a further embodiment similar to the lamp shown in FIG. 2. In this embodiment, the flame shield 61 of lamp 60 is also a continuation of the cylindrical-shaped body 13 of the envelope. The fuel cell 25 and the decorative insert 45 of the lamp is slipped easily into the body section through top opening 62 of the envelope. The top section of the flame shield is provided with an inclined, bevelled edge 63 which is both decorative and functional in that it provides a larger open area over the burner through which ample air can reach the flame to support combustion.

Figure 4:
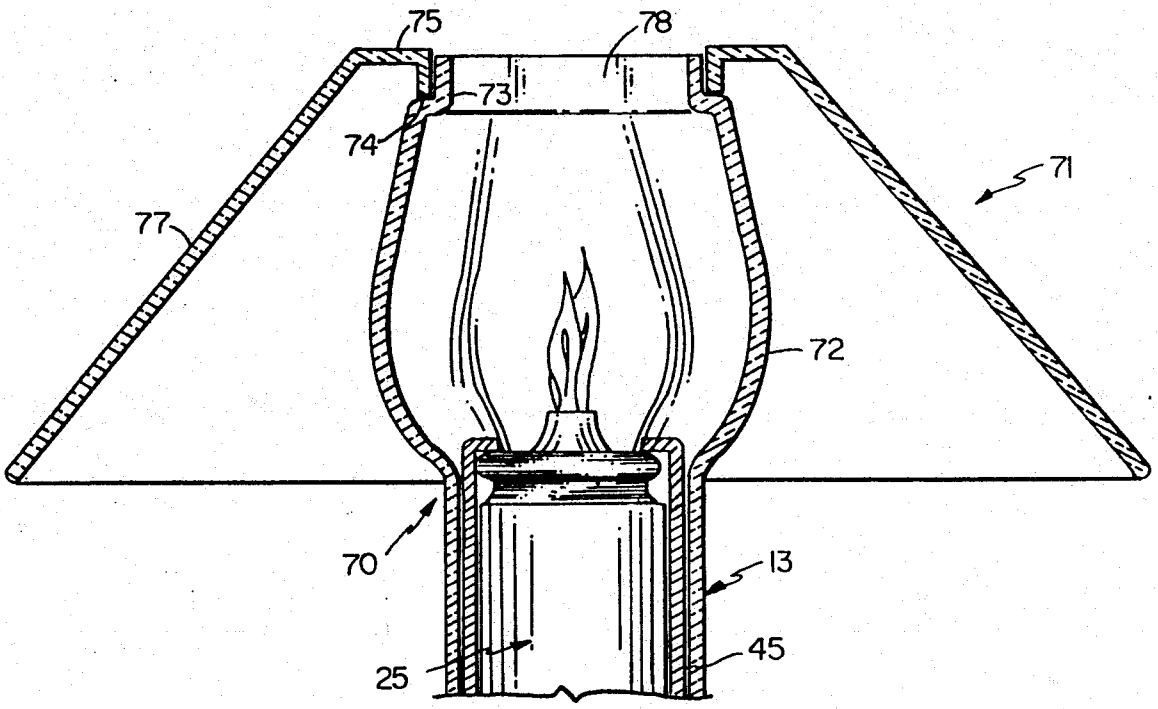
FIG. 4 is a side elevation, in section, illustrating a second shade mounting arrangement.

FIG. 4 is a partial plan view of a lamp 70 that is similar to the lamp depicted in FIG. 1. In this embodiment of the invention, the lamp again is equipped with a one-piece glass or plastic shade 71. The flame shield of the lamp is a radially-expanded globe 72 that terminates in a short, cylindrical chimney 73. A radially-expanded shoulder 74 is provided at the base of the chimney upon which the shade can be securely seated in assembly. The shade includes a ring-like, horizontally-disposed wall 75 having a downwardly depending sleeve 76 that encircles the globe chimney and which is arranged to seat securely upon the shoulder 74. The outer periphery of the wall 75 is turned downwardly at an angle to create a skirt 77 that surrounds the flame shield of the lamp. The chimney opening 78 is sufficiently wide to permit both the insert 45 and the fuel cell 25 to pass easily into the body 13 of the envelope.

It is envisioned that the lamp and the shade may be made from different colored glass or plastic from which various combinations can be assembled to provide different lamp combinations. Similarly, the shade can be relatively opaque, while the envelope made of a relatively transparent or clear material permits the decorative insert to be clearly seen. As noted above, the fuel cell can only be inserted and removed from the envelope through the top opening formed in the flame shield thus making unauthorized access to the fuel cell difficult. This, of course, discourages anyone from tampering with the fuel cell. The addition of a shade to the envelope makes access to with the fuel cell.

The clear opening that passes axially through the envelope helps in the removal of the fuel cell and the insert. An elongated tool can be passed upwardly through the passage into lifting contact with the bottom of the cell to guide the cell upwardly through the top opening. As noted above, the collar of the insert is adapted to close over the top of the cell and therefor will be pulled upwardly as the cell is being removed from the lamp.

While this invention has been described in the specification and illustrated in the drawings with reference to the preferred embodiments, it is not confined to the details set forth and this application is intended to cover any modifications and changes that may come within the scope of the following claims.

What is claimed is:

1. A table lamp that includes:

a single-piece, hollow, envelope made of glass or plastic with an axial passage passing upwardly therethrough from a bottom opening to a top opening, said envelope having an elongated, vertically-disposed cylindrical body section, a radially-expanded base being greater in diameter than the body section, an inwardly pinched neck located between the base and the body section, and a flame shield section forming said top opening and being positioned over said cylindrical body section, said flame shield section being in the form of a radially-expanded globe; and a cylindrical fuel cell having horizontally-disposed top and bottom walls, said fuel cell being slidably received within said cylindrical body section of said envelope through said top opening in the flame shield, said bottom wall of the cell being seated upon the pinched neck of said envelope, said fuel cell having a burner mounted upon said top wall thereof, said burner being surrounded by the flame shield when said fuel cell is seated upon the pinched neck of said envelope.

2. The lamp of claim 1 that further includes a removable shade means having a horizontally-disposed, annular support member seated on top of the flame shield, a downwardly extended sleeve depending from the inner edge of the support member that passes through the top opening in said flame shield section, and a downwardly-extended skirt depending from the outer edge of the support member that surrounds the flame shield.

3. The lamp of claim 2 wherein said shade means is also formed of a single piece of glass or plastic.

4. The lamp of claim 2 wherein said top opening in the flame shield is circular and the sleeve is a cylinder forming a close, sliding fit within said top opening.

5. The lamp of claim 2 wherein said flame shield section is a radially-expanded globe that surrounds the burner of the fuel cell and the skirt of the shade is a truncated cone.

6. The lamp of claim 1 wherein the fuel cell is a disposable unit containing a wick and a quantity of liquid fuel.

7. The lamp of claim 1 that further includes a removable, cylindrically-shaped insert positioned between the fuel cell and said cylindrical body section, said insert having a radially foreshortened collar at its upper end that partially closes over the top of the fuel cell thereby allowing said insert to hang from the fuel cell.

8. The lamp of claim 7 wherein said envelope is transparent and the outer wall of said insert has a decorative pattern that is discernable through said envelope.

9. The lamp of claim 1 wherein said cylindrical body section and said flame shield section of the envelope form a continuous cylinder having a uniform inside diameter.

10. The lamp of claim 9 wherein the top edge of the flame shield is bevelled at an angle.

11. The lamp of claim 1 wherein said flame shield section is a radially-expanded globe section having a raised circular chimney surrounding said top opening of the envelope.

12. The lamp of claim 11 that further includes a removable shade means having a horizontally-disposed, annular-shaped support member, a downwardly-disposed sleeve depending from the inner edge of said support member that is slidably received over the raised chimney of the globe and is seated on a shoulder formed in said globe, and a downwardly-disposed skirt depending from the outer edge of said support member that surrounds the globe.

13. The lamp of claim 12 wherein the shade means is formed of a single piece of glass.

* * * * *